US005599217A

United States Patent [19]

Ferrante

[11] Patent Number: 5,599,217

[45] Date of Patent: Feb. 4, 1997

[54] RAPID COOLING SYSTEM FOR LIQUID-COOLED ENGINES

[76] Inventor: Joseph Ferrante, 1 Landis Ct., Brooklyn, N.Y. 11229

[21] Appl. No.: 554,759

[22] Filed: Nov. 8, 1995

[51] Int. Cl.[6] ..... B63H 21/10

[52] U.S. Cl. ..... 440/88; 165/41

[58] Field of Search ..... 165/41; 440/1, 440/2, 88, 85; 114/198

[56] References Cited

U.S. PATENT DOCUMENTS

| | | | |
|---|---|---|---|
| 3,242,914 | 3/1966 | Benger | 440/88 |
| 4,842,559 | 6/1989 | Litjens et al. | 440/88 |
| 5,004,042 | 4/1991 | McMorries et al. | 440/88 |
| 5,045,001 | 9/1991 | Borst | 440/88 |

*Primary Examiner*—Stephen Avila
*Attorney, Agent, or Firm*—Michael I. Kroll

[57] ABSTRACT

A rapid cooling system is provided for a liquid-cooled inboard marine engine of the type having an engine, coolant liquid, an engine heat exchanger, engine coolant conduits between the engine and the engine heat exchanger, and a pump for circulating the coolant between the engine and the engine heat exchanger. The rapid cooling system comprises an external heat exchanger, external coolant conduits to and from the external heat exchanger, means for connecting the external coolant conduits to the engine coolant conduits, a first external pump for circulating the engine coolant through the external heat exchanger, water conduits between the external heat exchanger and an external source of relatively cool water, and a second external pump for circulating water from the external source of relatively cool water, via the water conduits, through the external heat exchanger.

4 Claims, 2 Drawing Sheets

RAPID COOLING SYSTEM FOR LIQUID-COOLED ENGINES

BACKGROUND OF THE INVENTION

Field of the Invention

The instant invention relates generally to liquid cooling systems for engines and more specifically it relates to an add-on device for rapidly cooling a liquid-cooled motor vehicle engine which has been turned off.

A great majority of the engines used in motor vehicles today rely on liquid cooling systems to prevent overheating. This includes, for example, gasoline and diesel engines in automobiles, motorcycles, trucks, buses, airplanes and boats. These cooling systems generally function by circulating a liquid, normally water or a water/coolant mixture, through the engine, where the liquid is heated, thus cooling the engine. The liquid is then pumped to a heat exchanger (e.g. a radiator) where it is cooled, usually by air passing over the heat exchanger. The cooled liquid is then recirculated to the engine in a continuous cycle.

When the engine is turned off, however, the cooling system is often turned off also, resulting in the engine temperature rising to extremely high levels or at least remaining elevated for a long period of time. This can cause problems related to excessive engine temperatures and inconvenience with regard to performing engine maintenance or repairs.

Additionally, in applications such as in motorboats and campers when the vehicle remains occupied when the engine is not running, the residual engine heat can result in the passenger compartment temperature rising to uncomfortable or even unsafe levels for many hours, especially as the engines are typically housed in enclosed areas which do not permit the engine heat to dissipate easily. This can also place great stress on air conditioning systems, when present.

In some engines, the cooling system will continue to run when the engine is turned off. Its effective is diminished, however, because the air flow over the heat exchanger is greatly diminished in a stationary vehicle.

The instant invention takes advantage of the pre-existing liquid cooling circulation systems of such engines. When connected to a hot engine which has been turned off, the instant invention enables the hot engine to be rapidly and easily cooled to ambient temperatures, typically in less than one hour.

SUMMARY OF THE INVENTION

A primary object of the present invention is to provide for the rapid cooling of a hot liquid-cooled engine which has been turned off.

Another object is to provide a rapid cooling system for liquid-cooled engines that utilizes an add-on system which connects with the engine's existing cooling system for use when the engine is not running.

An additional object is to provide a rapid cooling system for liquid-cooled engines that utilizes an external hot water circulating pump and heat exchanger for cooling the engine's cooling liquid and, hence, the engine itself.

A further object is to provide a rapid cooling system for liquid-cooled engines wherein the external heat exchanger cools the engine by transferring the engine heat from the engine's hot coolant liquid to an external source of cool water.

A still further object is to provide a rapid cooling system for liquid-cooled engines that is simple and easy to use.

A still further object is to provide a rapid cooling system for liquid-cooled engines that is portable, rapidly reusable and suitable for use on a variety of engines.

A still further object is to provide a rapid cooling system for liquid-cooled engines that is economical in cost to manufacture and use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
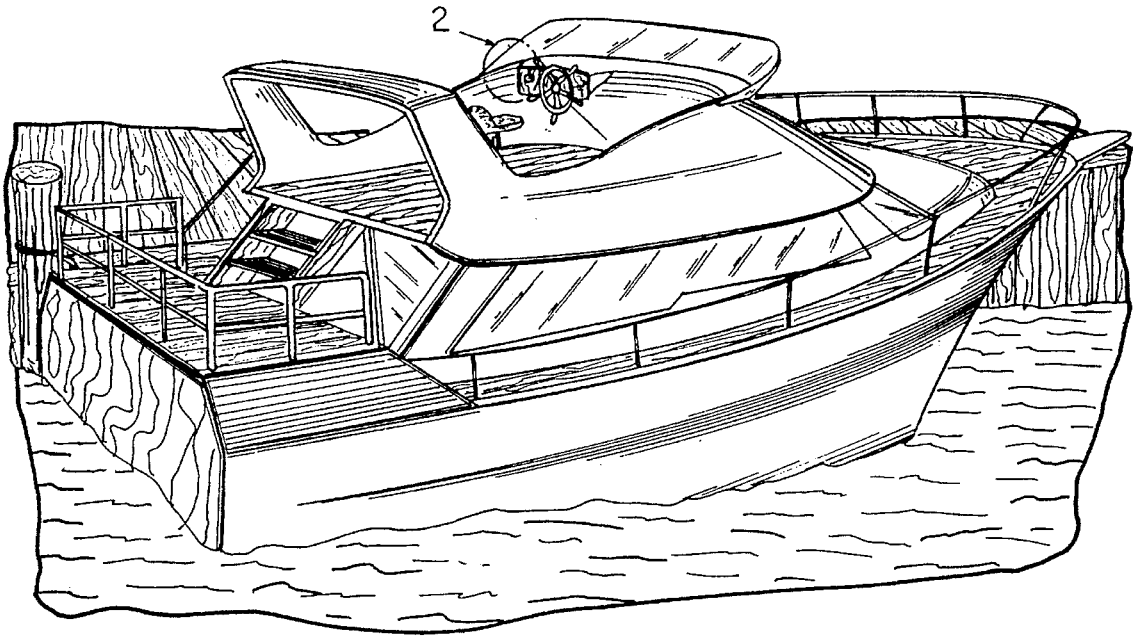
FIG. 1 is an exterior view of a boat adapted for use of the present invention.
Figure 2:
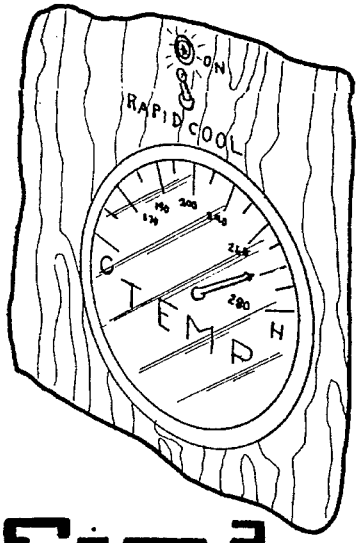
FIG. 2 is a close-up view of the helm 2 from FIG. 1, showing the engine controls.
Figure 3:
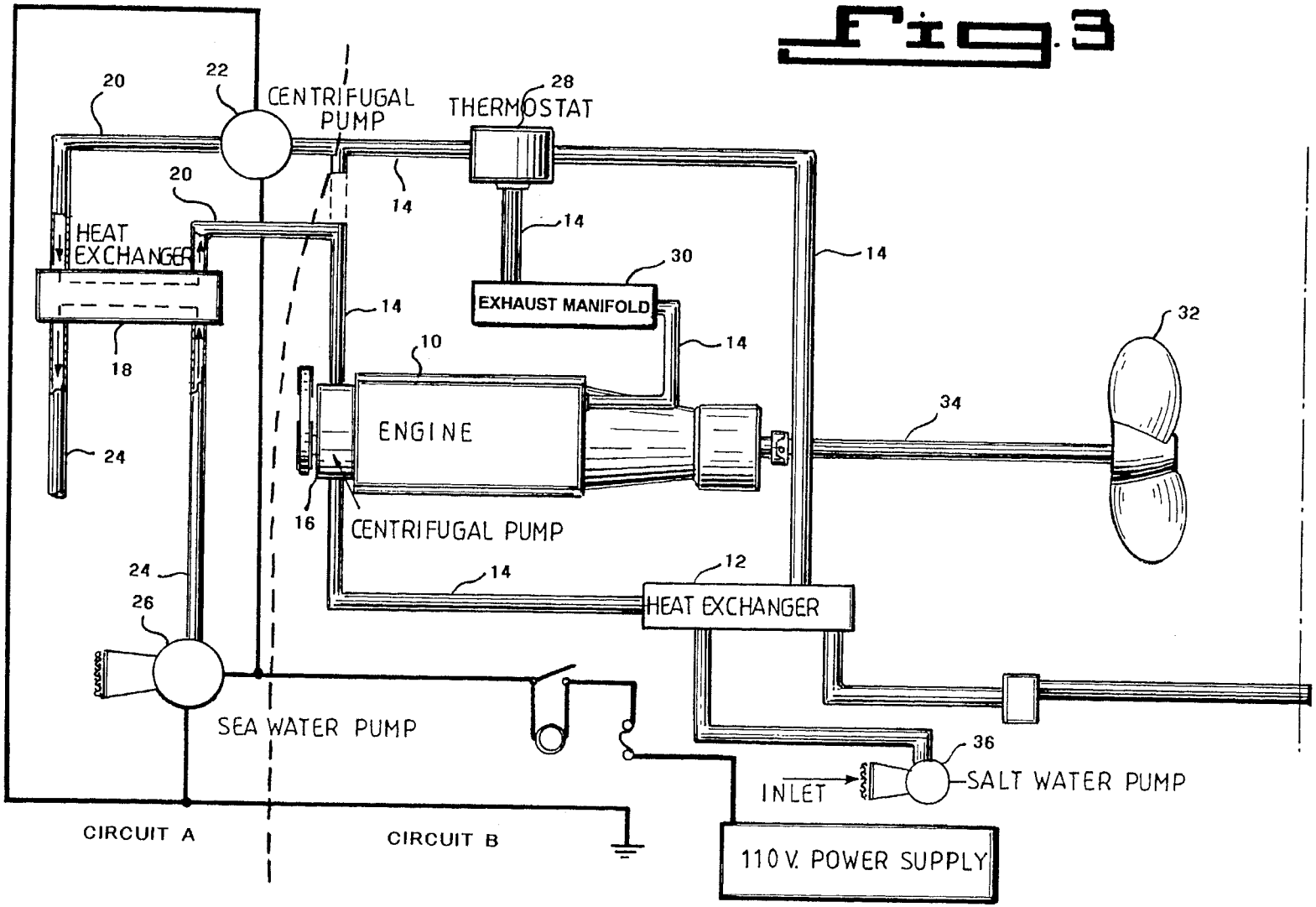
FIG. 3 is a diagrammatic illustration of a marine engine and cooling system (Circuit B) which has been adapted with the cooling system of the present invention (Circuit A).

Turning now descriptively to the drawings, in which similar reference characters denote similar elements throughout the several views, FIGS. 1 through 3 illustrate a rapid cooling system for liquid-cooled engines. FIG. 3 illustrates a rapid cooling system, Circuit A, for a liquid-cooled inboard marine engine, Circuit B, of the type having an engine 10, coolant liquid (not shown), an engine heat exchanger 12, engine coolant conduits 14 between the engine 10 and the engine heat exchanger 12, and a pump 16 for circulating the coolant between the engine 10 and the engine heat exchanger 12, the rapid cooling system, Circuit A, comprising an external heat exchanger 18, external coolant conduits 20 to and from the external heat exchanger 18, means (not shown) for connecting the external coolant conduits 20 to the engine coolant conduits 14, a first external pump 22 for circulating the engine coolant through the external heat exchanger 18, water conduits 24 between the external heat exchanger 18 and an external source of relatively cool water 38, and a second external pump 26 for circulating water from the external source of relatively cool water 38, via the water conduits 24, through the external heat exchanger 18.

It can be readily appreciated that the precise orientation of the engine and its primary cooling system (Circuit B) is not critical to the instant invention. FIG. 2, for example, shows the engine on/off switch and the engine temperature gauge, while FIG. 3 further shows the following typical components: thermostat 28; exhaust manifold 30; propeller 32; propeller drive shaft 34; and salt water pump 36.

Figure 2A:
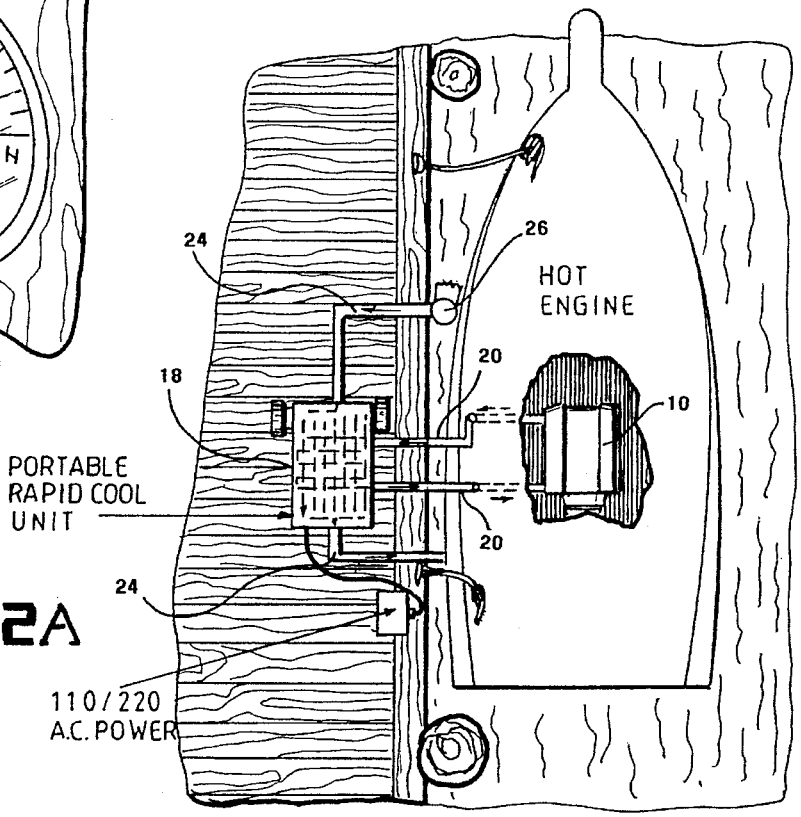
FIG. 2A is an aerial, cross-sectional view of the boat from FIG. 1, showing the preferred embodiment of the present invention as an external, portable unit which can be conveniently wheeled along the dock and connected to a boat with an engine in need of cooling.

FIG. 2A illustrates the preferred embodiment of the present invention. A boat with a hot engine 10 is tied to a dock. The portable, external rapid cooling unit can be conveniently and easily wheeled up to the boat, plugged into an appropriate power source and connected to the engine's primary cooling system. The cooling unit's water conduits are simply placed in the water adjacent to the dock and the unit is activated. The hot coolant from the engine and the cool water from the sea both pass through the external heat exchanger, cooling the engine quickly and easily.

In practicing the present invention, the external supply of relatively cool water will vary depending on the type and location of the engine to be cooled. For example, the present invention is particularly suitable for use in inboard marine engines, because of the ready availability of water from the sea, lake, bay, etc. in which the boat is located. The term "relatively cool" simply means that the external source of water must be cooler than the engine coolant. It can be readily appreciated that, in marine use as described herein, the external source of water will always be cool relative to the hot engine. It can be appreciated also that, in an alternative embodiment of the invention, the external heat exchanger 18 can be placed directly in the external source of water, thus eliminating the need for conduits 24 and pump 26.

With further regard to the external source of relatively cool water, the source of the water is not critical and will depend on the circumstances of use. For example, automobiles, trucks and other land-based vehicles can utilize water from lakes, ponds, cisterns, streams, rivers, swimming pools, hoses etc. Again, the source itself is not critical as long as the water temperature is lower than the temperature of the engine coolant.

The external coolant conduits 20 are removably connected to the engine coolant conduits 14 by standard means, for example, quick-release couplings which allow the present invention to be readily connected and disconnected. When the present invention is not connected, the engine's cooling system functions normally.

Once activated, the present invention can be left on until the engine is cooled to the level desired. For example, a thermostat can be utilized so that the system shuts off when the engine temperature reaches a predetermined level. Alternatively, the system could be connected to a timer so that the engine is cooled for a predetermined length of time.

LIST OF REFERENCE NUMBERS

2 helm inset, shown in FIG. 2
10 engine
12 engine heat exchanger
14 engine coolant conduits
16 engine coolant pump
18 external heat exchanger
20 external coolant conduits
22 first external pump
24 water conduits
26 second external pump
28 thermostat
30 exhaust manifold
32 propeller
34 propeller drive shaft
36 salt water pump
38 external source of relatively cool water
40 engine temperature gauge
42 engine on/off switch It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A rapid cooling system for a liquid-cooled engine comprising:

a) an internal combustion engine having an engine heat exchanger, a radiator, primary coolant liquid, and pump means for circulating said primary coolant liquid through said engine and said radiator to control the temperature of said engine;

b) an external heat exchanger;

c) external coolant conduits to and from said external heat exchanger;

d) quick disconnect means for connecting said external coolant conduits to the engine coolant conduits;

e) external pump means for circulating primary engine coolant through said external heat exchanger; and f) means for providing a source of a secondary coolant for circulation through said external heat exchanger comprising water conduits to and from said external heat exchanger and means for circulating water from an external source of relatively cool water via said water conduits and through said external heat exchanger.

2. A rapid cooling system for a liquid-cooled engine as recited in claim 1 in which said engine is a marine engine in a boat, said external source of water is sea water, and said external heat exchanger, external coolant conduits, quick disconnect means, and external pump means are assembled into a portable cooling unit for use with a docked vessel as needed.

3. A rapid cooling system for liquid-cooled engines as recited in claim 1, further comprising a thermostat for turning the system off when the engine is cooled to a predetermined temperature.

4. A rapid cooling system for liquid-cooled engines as recited in claim 1, further comprising a timer for turning the system off after a predetermined length of time.

* * * * *